US005884115A

United States Patent [19]

Maruhashi

[11] Patent Number: 5,884,115

[45] Date of Patent: Mar. 16, 1999

[54] PHOTOSENSITIVE MATERIAL PROCESSING APPARATUS

[75] Inventor: Atsushi Maruhashi, Kanawaga, Japan

[73] Assignee: Fuji Photo Film Co., Ltd., Kanagawa, Japan

[21] Appl. No.: 14,164

[22] Filed: Jan. 27, 1998

[30] Foreign Application Priority Data

Mar. 18, 1997 [JP] Japan ..... 9-064803

[51] Int. Cl.[6] ..... G03D 3/08

[52] U.S. Cl. ..... 396/614; 355/27; 134/83; 134/111; 134/122 P; 396/617; 396/626

[58] Field of Search ..... 396/612, 614, 396/620, 617, 625, 626; 355/27–29; 134/83, 111, 122 P; 118/30, 121, 26, 662, 424

[56] References Cited

U.S. PATENT DOCUMENTS 5,400,103 3/1995 Nagaosa ..... 396/614

*Primary Examiner*—D. Rutledge

*Attorney, Agent, or Firm*—Sughrue, Mion, Zinn, Macpeak & Seas, PLLC

[57] ABSTRACT

A first roller, which contacts a photographic printing paper with the first roller being formed longer than the width of the photographic printing paper, is disposed at the conveying direction downstream side of the photographic printing paper with respect to a developing tank. A second roller, which contacts the photographic printing paper with the second roller being formed shorter than or equal to the width of the photographic printing paper, is disposed at a position at which the photographic printing paper can be nipped by the first and second rollers. The first and second rollers form squeeze rollers. Because the clearance between the sides of the squeeze rollers in the widthwise direction of the photographic printing paper is wide, the squeezed processing solution conveyed from the clearance to the downstream side of the photographic printing paper is small.

20 Claims, 7 Drawing Sheets

PHOTOSENSITIVE MATERIAL PROCESSING APPARATUS

BACKGROUND OF THE INVENTION

1. Field of the Invention

The present invention relates to a photosensitive material processing apparatus in which processing solution for processing a photosensitive material is reliably squeezed from the photosensitive material and which is suitable for, for example, a printer processor, a film processor, and the like.

2. Description of the Related Art

For example, a plurality of processing tanks which stores processing solution or water for color development, bleach-fixing, rinsing, stabilization, and the like is provided at a photosensitive material processing apparatus (e.g., a film processor, a printer processor, and the like) serving as an automatic processor. As a film or a color paper serving as a photosensitive material is conveyed into these processing tanks in a predetermined order, the film or the color paper is developed.

In the development processing, squeeze rollers formed by a pair of rollers are provided at respective processing tanks so as to nip the photosensitive material. The processing solution in each of the processing tanks is squeezed from the photosensitive material by the squeeze rollers and will not be introduced into the next processing tank. A pair of rollers which is wider than the width of the photosensitive material has been used for the squeeze rollers.

However, when the processing solution is squeezed from the photosensitive material by the squeeze rollers, because the photosensitive material is nipped by the pair of rollers which is wider than the width of the photosensitive material, the transverse direction end portions of the photosensitive material are nipped by these rollers. As a result, the processing solution wiped off from the surfaces of the photosensitive material by the pair of rollers may be applied again to the photosensitive material.

Namely, as shown in FIGS. 8A and 8B, when processing solution L applied onto a photosensitive material P is wiped off by squeeze rollers 116 formed by a roller 112 and a roller 114, a solution storing portion 118 generates at the upstream side of a portion between the pair of rollers 112, 114. The processing solution L flows from the solution storing portion 118 to the conveying direction downstream side of the photosensitive material P with respect to the squeeze rollers 116 through a gap S which is formed between the pair of rollers and at the side end portions of the photosensitive material P. Accordingly, there is worry that the processing solution L is applied again to the photosensitive material P which has passed between the squeeze rollers 116 and that the processing solution L is introduced into the next processing tank.

SUMMARY OF THE INVENTION

With the aforementioned in view, an object of the present invention is to provide a photosensitive material processing apparatus in which the amount of processing solution which is conveyed and not squeezed by squeeze rollers can be greatly reduced.

The present invention is an apparatus for removing processing solution from a photosensitive material which has been taken out from a processing tank, comprising: a pair of rollers which nips the photosensitive material taken out from the processing tank, the clearance between the pair of rollers being narrow at a portion within the width dimension of the photosensitive material and the clearance between the pair of rollers being wide at a portion at which the photosensitive material does not exist.

Namely, when the pair of rollers is used for removing processing solution applied to the photosensitive material, the width of one of the rollers is shorter than or equal to the width of the photosensitive material. Consequently, the side end portions of the photosensitive material will not be nipped by the pair of rollers and a gap will not be formed at the side end portions of the photosensitive material.

As a result, the flowing-out of the processing solution from a solution storing portion through a gap formed between the pair of rollers can be prevented, and the amount of application of the processing solution onto the photosensitive material which has passed between the squeeze rollers can be reduced.

From the above description, compared to the case of conventional roller pair whose widths are larger than the width of the photosensitive material, the ability of wiping off the processing solution improves greatly and the amount of processing solution which is conveyed and not squeezed by the pair of rollers is reduced.

In the roller pair of the present invention, the axial dimension of one of the roller pair may be long and the axial dimension of the other of the roller pair may be short. Further, the other of the roller pair may be a so-called skewered roller in which a plurality of rollers whose axial dimension is short is disposed at predetermined intervals.

DESCRIPTION OF THE PREFERRED EMBODIMENTS

A photosensitive material processing apparatus relating to a first embodiment of the present invention will be described on the basis of the drawings.

Figure 1:
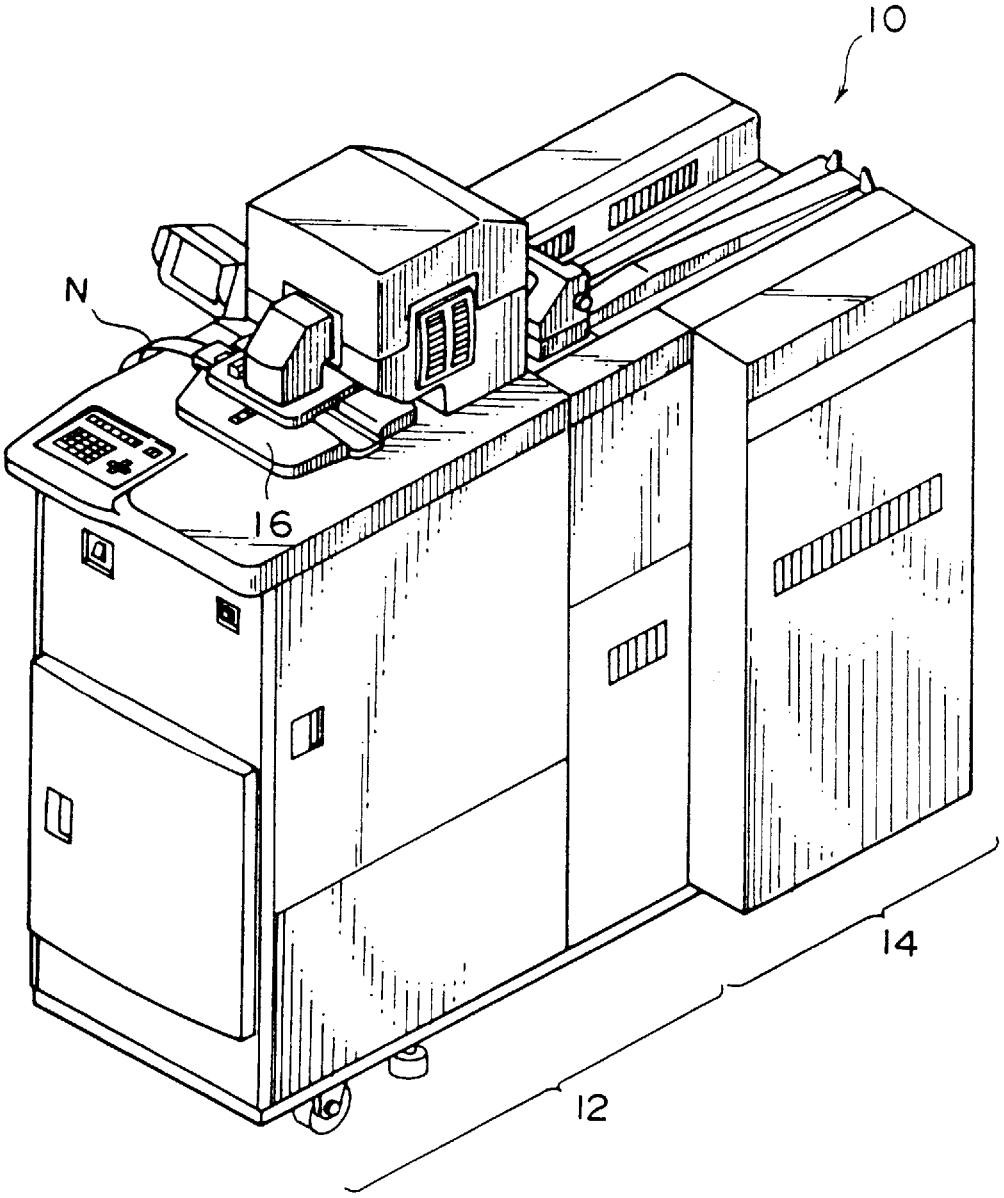
FIG. 1 is a perspective view of a printer processor relating to a first embodiment of the present invention.

FIG. 1 shows a perspective view of a schematic overall structure of a printer processor 10 serving as a photosensitive material processing apparatus of the first embodiment.

The printer processor 10 includes a printer section 12 and a processor section 14. At the printer section 12, images of a negative film N loaded in a negative carrier 16 are printed onto an unillustrated photographic printing paper P serving as a photosensitive material. The photographic printing paper P is conveyed to the processor section 14.

A developing tank, a bleach-fixing tank, a rinsing tank and a drying portion (not shown in FIG. 1) are provided at the processor section 14 and the photographic printing paper P conveyed from the printer section 12 is developed.

Figure 2:
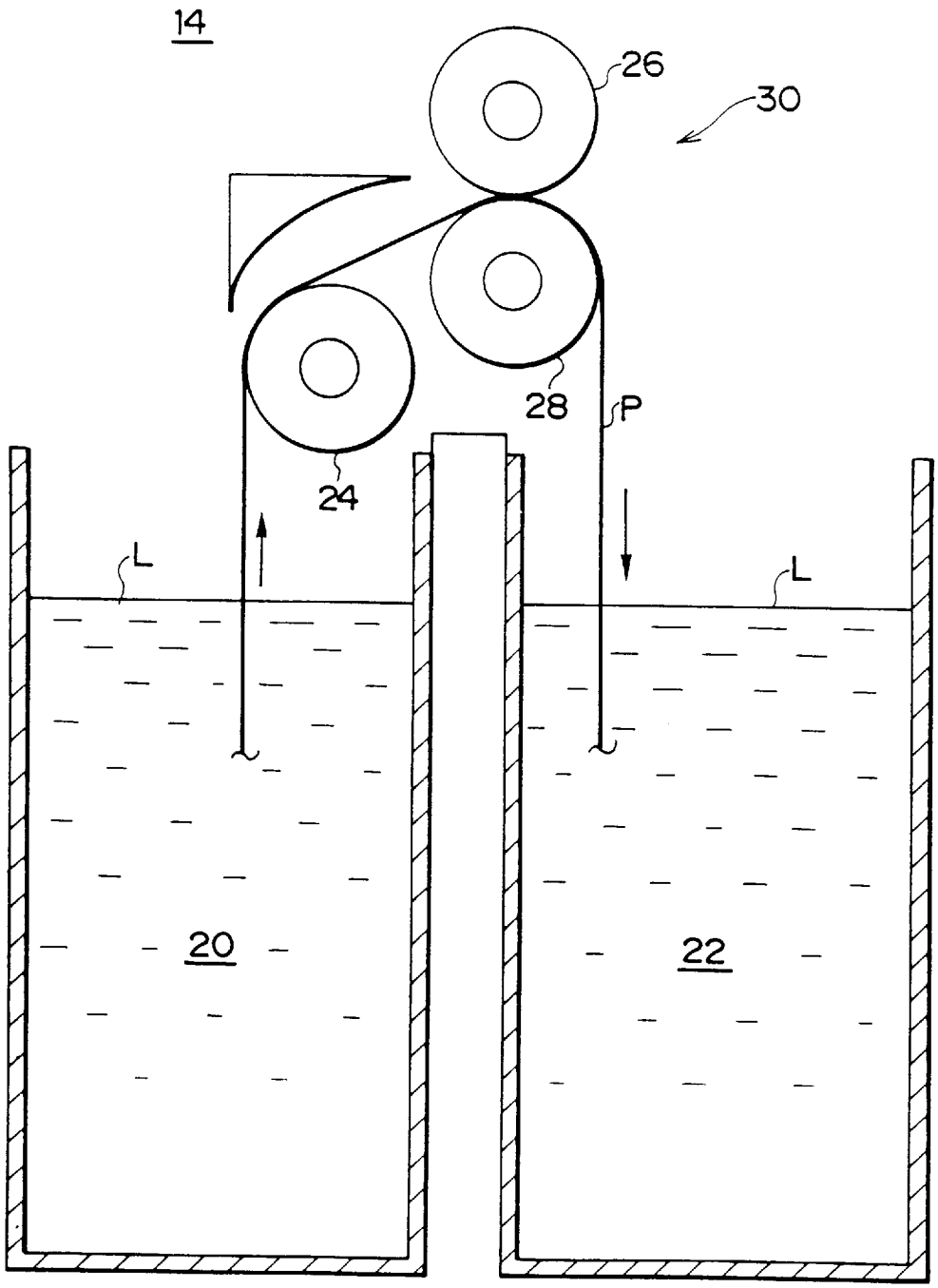
FIG. 2 is a cross-sectional view of a processor section relating to the first embodiment of the present invention.

Next, as shown in FIG. 2, a structure of wiping off the processing solution L will be explained by using a developing tank 20 of the processing tanks as an example.

The processing tank 20 which stores developer serving as the processing solution L for processing the photographic printing paper P is disposed within the processor section 14. A guide roller 24 which guides the photographic printing paper P is disposed at the conveying direction downstream side of the photographic printing paper P with respect to the developing tank 20.

Figure 3B:
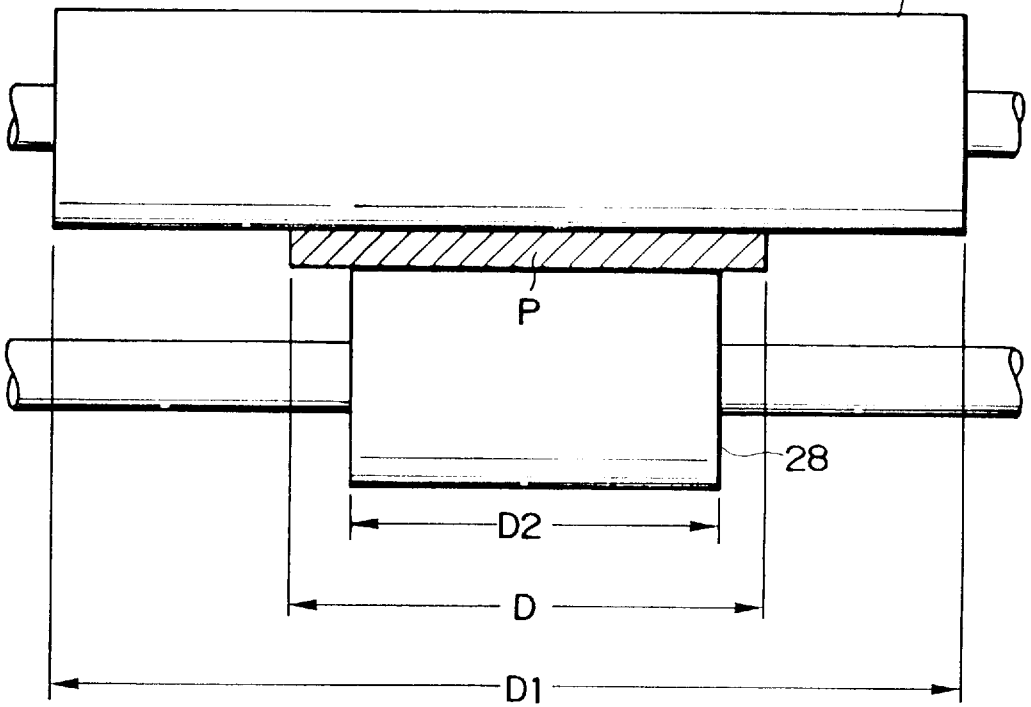
FIG. 3B is an elevational view of the squeeze rollers relating to the first embodiment of the present invention.
Figure 3A:
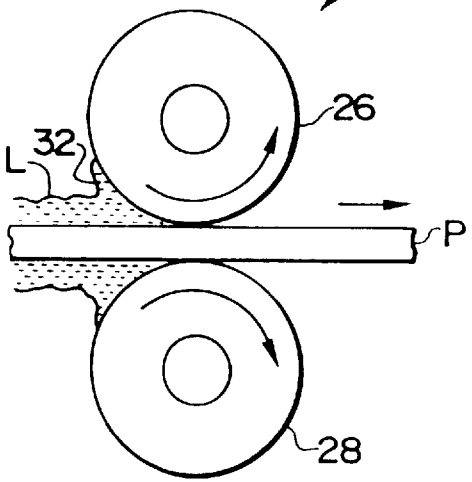
FIG. 3A is a side view of squeeze rollers relating to the first embodiment of the present invention.

As shown in FIG. 3B, a first roller 26 contacts the photographic printing paper P with a photosensitive material contact-guide portion of the first roller 26 being formed longer than the width of the photographic printing paper P. The first roller 26 is disposed at the conveying direction downstream side of the photographic printing paper P with respect to the guide roller 24 and at the conveying direction downstream side of the photographic printing paper P with respect to the developing tank 20. Further, a second roller 28 contacts the photographic printing paper P with a photosensitive material contact-guide portion of the second roller 28 being formed shorter than or equal to the width of the photographic printing paper P. The second roller 28 is disposed at a position at which the photographic printing paper P is nipped between the first roller 26 and the second roller 28. The first roller 26 and the second roller 28 form squeeze rollers 30.

Moreover, a bleach-fixing tank 22 serving as the next processing tank is disposed at the conveying direction downstream side of the photographic printing paper P with respect to the squeeze rollers 30.

Namely, when the pair of rollers 26, 28 are used for removing the processing solution L applied to the photographic printing paper P, the width of the second roller 28, which is one of the roller pair, is made shorter than or equal to the width of the photographic printing paper P such that the side end portions of the photographic printing paper P will not be caught between the pair of rollers 26, 28.

Next, the operation of the first embodiment will be explained.

When the pair of rollers 26, 28 are used for removing the processing solution L applied to the photographic printing paper P, the width of the second roller 28 is made shorter than or equal to the width of the photographic printing paper P. Thus, the side end portions of the photographic printing paper P will not be caught between the pair of rollers 26, 28, and a gap will not be formed at the side end portions of the photographic printing paper P.

As a result, the flowing-out of processing solution L from the solution storing portion 32 formed between the pair of rollers 26, 28 through the gap between the pair of rollers 26, 28 can be prevented, and the amount of application of the processing solution L onto the photographic printing paper P which has passed between the squeeze rollers 30 can be reduced.

From the above description, compared to the case of conventional roller pair which has larger width than the width of the photographic printing paper P, the ability of wiping off the processing solution L greatly improves, and the amount of processing solution L which is conveyed and not squeezed by the pair of rollers 26, 28 can be reduced.

Next, comparisons of characteristics between the squeeze rollers 30 of the first embodiment and the squeeze rollers of conventional art are described below. Namely, the following Table 1 gives conditions of rollers in the first embodiment and the results of measurement of the amount of variation of the processing solution in the developing tank 20. As shown in FIG. 3B, the width D of the photographic printing paper P is 89 mm, the width D1 of the first roller 26 is 167 mm, the width D2 of the second roller 28 is 75 mm, and the conveying speed of the photographic printing paper P is about 40 mm/s.

TABLE 1

Conditions of Rollers in First Embodiment

| | guide roller | first roller | second roller |
|---|---|---|---|
| material | PVC | silicon rubber | PVC |
| diameter | ϕ21 | ϕ22 | ϕ21 |
| width | 167 mm | 167 mm | 167 mm→75 mm (replaced) |

Results of Measurement of Amount of Variation of Processing Solution in Developing Tank

| width of second roller | amount of variation of solution (per 1 $m^2$ of photosensitive material) |
|---|---|
| ordinary roller (167 mm) | 39.0 g |
| narrow roller (75 mm) | 25.2 g |

The amount of processing solution to be conveyed is reduced to about two-thirds of the amount thereof in the prior art.

Next, a photosensitive material processing apparatus relating to a second embodiment of the present invention will be explained on the basis of the drawing. Members which are the same as those described in the first embodiment are denoted by the same reference numerals, and repetitive descriptions thereof are omitted.

Figure 4:
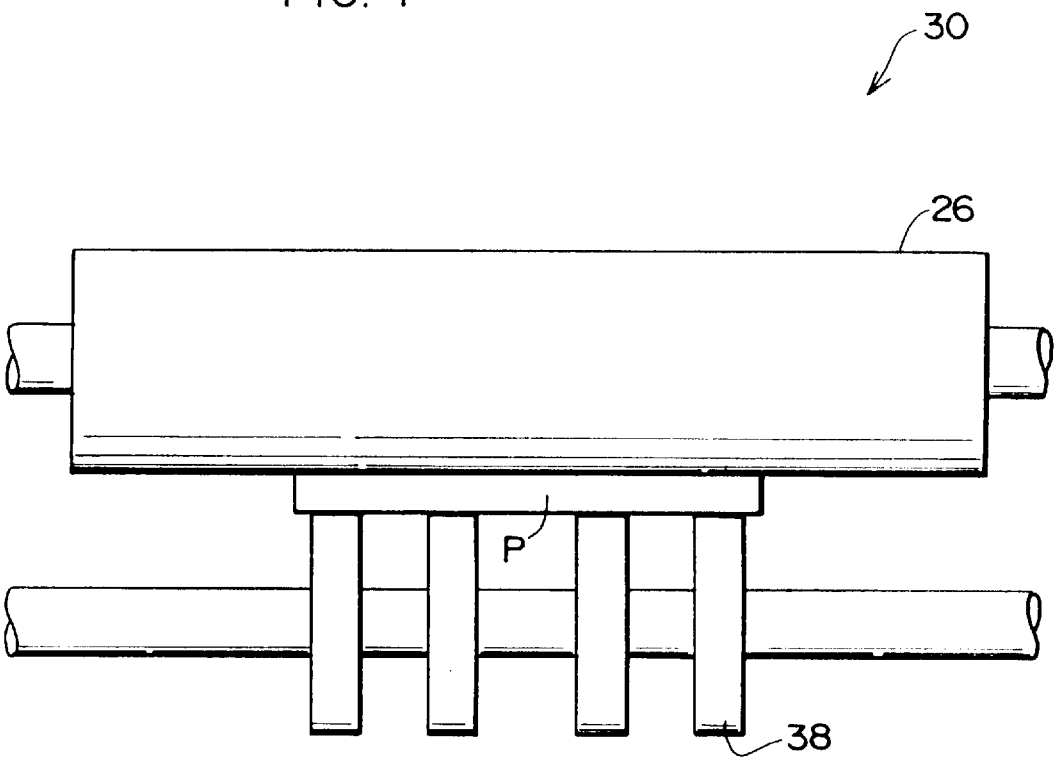
FIG. 4 is an elevational view of squeeze rollers relating to a second embodiment of the present invention.

As shown in FIG. 4, in the second embodiment, a skewered second roller 38 in which a plurality of narrow rollers is placed in a row is used instead of the second roller 28 of the first embodiment.

Namely, a first roller 26, which is formed longer than the width of a photographic printing paper P and contacts the photographic printing paper P, is disposed at the conveying direction downstream side of the photographic printing paper P with respect to a developing tank 20 which processes the photographic printing paper P. The skewered second roller 38, which is formed shorter than or equal to the width of the photographic printing paper P and contacts the photographic printing paper P, is disposed at a position at which the photographic printing paper P is nipped between the first roller 26 and the second roller 38.

Accordingly, in the same manner as the first embodiment, the amount of processing solution L which is conveyed and not squeezed by the pair of rollers 26, 38 is reduced in the second embodiment.

Next, a photosensitive material processing apparatus relating to a third embodiment of the present invention will be explained on the basis of the drawing. Members which are the same as those described in the first embodiment are denoted by the same reference numerals, and repetitive descriptions thereof are omitted.

Figure 5:
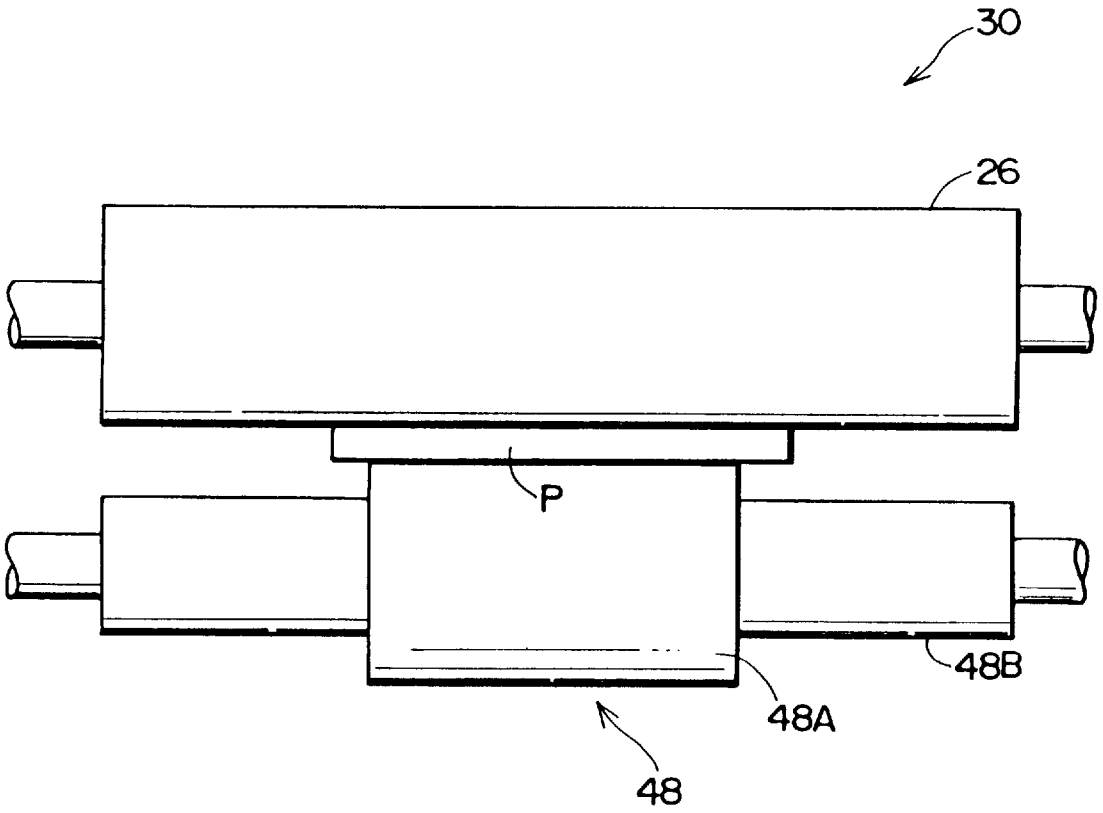
FIG. 5 is an elevational view of squeeze rollers relating to a third embodiment of the present invention.

As shown in FIG. 5, in the third embodiment, a second roller 48 whose roller width is wider than the width of a photographic printing paper P and whose width of a portion contacting the photographic printing paper P is narrower than the width of the photographic printing paper P is used instead of the second roller 28 in the first embodiment.

Namely, a first roller 26, which is formed longer than the width of the photographic printing paper P and contacts the photographic printing paper P, is disposed at the conveying direction downstream side of the photographic printing paper P with respect to a processing tank 20 which processes the photographic printing paper P. Further, the second roller 48 includes a large-diameter portion 48A and a small-diameter portion 48B. The large-diameter portion 48A is formed shorter than or equal to the width of the photographic printing paper P and contacts the photographic printing paper P. The diameter of the small-diameter portion 48B is smaller than that of the large-diameter portion 48A. The small-diameter portion 48B extends from the end portions of the large-diameter portion 48A and is formed longer than the width of the photographic printing paper P. The second roller 48 is disposed at a position at which the photographic printing paper P is nipped between the first roller 26 and the second roller 48.

Therefore, in the same manner as the first embodiment, the amount of processing solution L which is conveyed and not squeezed by the pair of rollers 26, 48 is reduced in the third embodiment.

Figure 6:
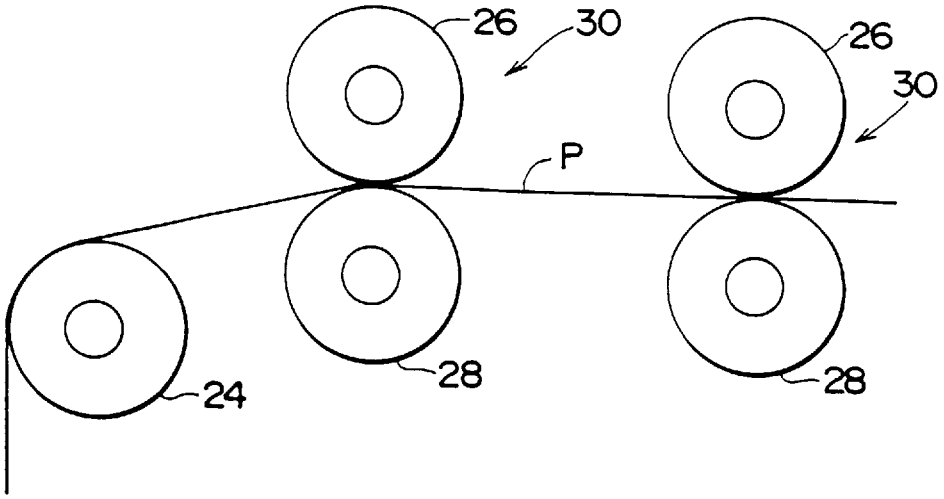
FIG. 6 is a side view of squeeze rollers relating to a first variant example of the present invention.
Figure 7:
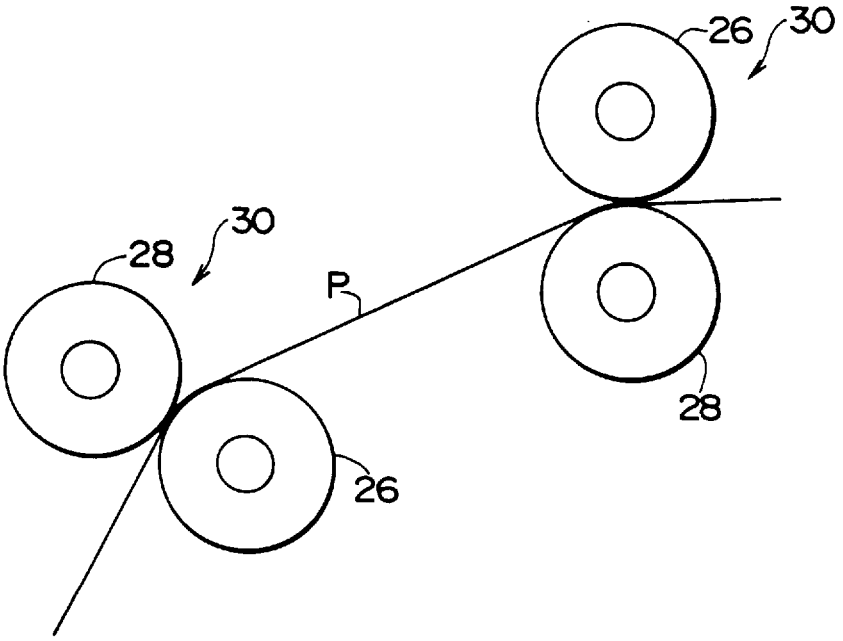
FIG. 7 is a side view of squeeze rollers relating to a second variant example of the present invention.
Figure 8B:
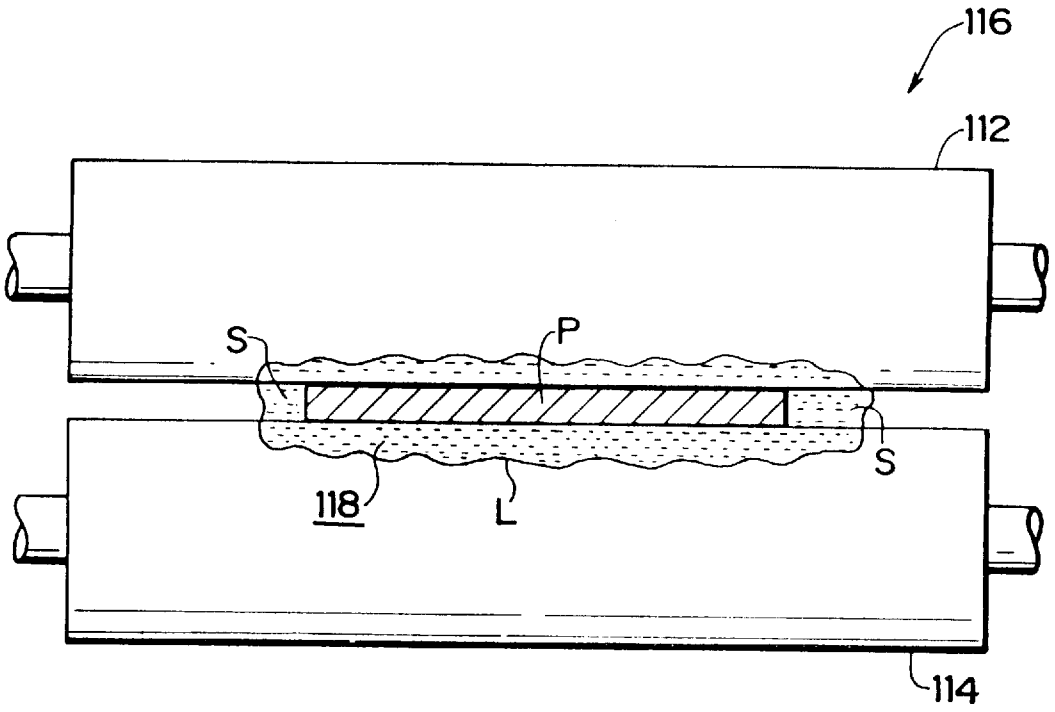
FIG. 8B (PRIOR ART)
FIG. 8B is an elevational view of the squeeze rollers relating to the conventional art.
Figure 8A:
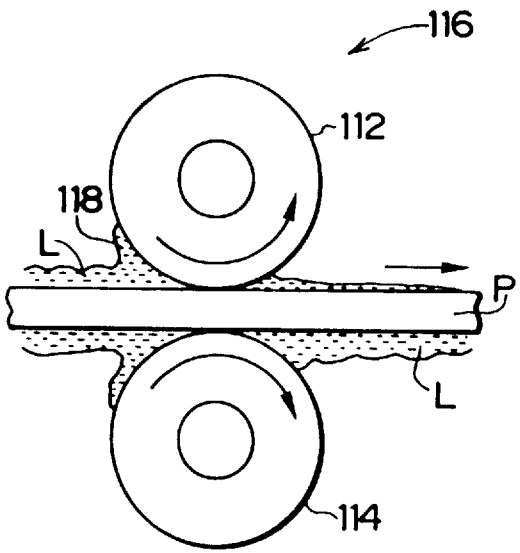
FIG. 8A (PRIOR ART)
FIG. 8A is a side view of squeeze rollers relating to a conventional art.

Next, as a variant example of the above embodiments, as shown in FIG. 6, two pairs of squeeze rollers 30, in which the respective lower side rollers are narrower than the respective upper side rollers, may be disposed at the conveying direction downstream sides of a photographic printing paper P with respect to a guide roller 24. Further, as shown in FIG. 7, squeeze rollers 30, in which a second roller 28 is placed at the lower side thereof, may be disposed at the downstream side of a photographic printing paper P with respect to squeeze rollers 30, in which a second roller 28 having narrowed width is placed at the upper side thereof. Namely, one or more second roller(s) 28 having narrowed width(s) may be provided on both surfaces of the photographic printing paper P.

In the same manner as the above embodiments, the amount of processing solution to be conveyed can be reduced by these roller arrangements.

Regarding the material, the diameter, the hardness, and the surface roughness of the rollers in the above embodiments, any rollers may be used provided that the rollers are used for the standard squeeze rollers. However, hydrophilic or water repellent rollers are preferable to water absorbing rollers.

Furthermore, the squeeze rollers relating to the present invention are not only used between solution tanks such as the developing tank and the fixing tank, the fixing tank and the rinsing tank, and the like, but also used between the solution tank and the drying portion.

What is claimed is:

1. An apparatus for removing processing solution from a photosensitive material which has been taken out from a processing tank, comprising:

a pair of rollers which nips the photosensitive material taken out from the processing tank, the clearance between the pair of rollers being narrow at a portion within the width dimension of the photosensitive material and the clearance between the pair of rollers being wide at a portion at which the photosensitive material is non-existent, whereby the processing solution squeezed by said pair of rollers is prevented from entering into the downstream side of the photosensitive material through the widthwise direction sides of the photosensitive material.

2. An apparatus for removing processing solution according to claim 1, wherein a photosensitive material contact-guide portion of one of said pair of rollers is longer than the widthwise dimension of the photosensitive material, and a photosensitive material contact-guide portion of another of said pair of rollers is shorter than the widthwise dimension of the photosensitive material.

3. An apparatus for removing processing solution according to claim 2, wherein said other roller includes a large-diameter portion and a small-diameter portion, and the large-diameter portion serves as the photosensitive material contact-guide portion.

4. An apparatus for removing processing solution according to claim 2, wherein said one roller is disposed above said other roller and said other roller is disposed below said one roller.

5. An apparatus for removing processing solution according to claim 4, wherein said other roller is disposed above the processing tank such that the photosensitive material is trained around and guided by said other roller.

6. An apparatus for removing processing solution according to claim 2, wherein a plurality of said pairs of rollers is provided.

7. An apparatus for removing processing solution according to claim 1, wherein the outer diameter of one of said pair of rollers is small at a portion which is non-correspondent to the photosensitive material.

8. A photosensitive material processing apparatus which includes a section for removing processing solution from a photosensitive material which has been taken out from a processing tank, comprising:

(a) a first roller, the transverse direction entire area of the photosensitive material contact-guide portion of the first roller contacting one surface of the photosensitive material taken out from the processing tank; and (b) a second roller, the photosensitive material contact-guide portion of the second roller opposing said first roller, and the second roller contacting the photosensitive material with the second roller being shorter than or equal to the widthwise dimension of another surface of the photosensitive material taken out from the processing tank, whereby the processing solution applied to the photosensitive material is wiped off by said rollers and the wiped-off processing solution is prevented from entering into the downstream side of the photosensitive material through said rollers.

9. A photosensitive material processing apparatus according to claim 8, wherein said other roller includes a large-diameter portion and a small-diameter portion, and the large-diameter portion serves as the photosensitive material contact-guide portion.

10. A photosensitive material processing apparatus according to claim 8, wherein said one roller is disposed above said other roller and said other roller is disposed below said one roller.

11. A photosensitive material processing apparatus according to claim 9, wherein said other roller is disposed above the processing tank such that the photosensitive material is trained around and guided by said other roller.

12. A photosensitive material processing apparatus according to claim 9, wherein a plurality of said pairs of rollers is provided.

13. A photosensitive material processing apparatus, comprising:

(a) a first roller which is disposed at the conveying direction downstream side of a photosensitive material with respect to a processing solution which processes the photosensitive material, and said first roller contacting the photosensitive material with the photosensitive material contact-guide portion of said first roller being formed longer than the width of the photosensitive material; and (b) a second roller which is disposed at a position at which the photosensitive material is nipped by said first roller and said second roller, and said second roller contacting the photosensitive material with the photosensitive material contact-guide portion of said second roller being skewered and formed shorter than or equal to the width of the photosensitive material.

14. A photosensitive material processing apparatus according to claim 13, wherein a plurality of said skewered rollers is disposed at predetermined intervals in the transverse direction of the photosensitive material.

15. A photosensitive material processing apparatus according to claim 13, wherein a plurality of rollers whose widthwise dimension is narrow is disposed coaxially in said skewered roller.

16. A photosensitive material processing apparatus according to claim 13, wherein in said skewered roller, some of the plurality of rollers whose widthwise dimension is narrow press said first roller via the vicinity of a widthwise direction central portion of the photosensitive material and the other of the plurality of rollers whose widthwise dimension is narrow press said first roller via the vicinities of widthwise direction end portions of the photosensitive material.

17. A photosensitive material processing apparatus according to claim 15, wherein the plurality of rollers whose widthwise dimension is narrow is fixed coaxially to a small-diameter supporting axis in said skewered roller.

18. A photosensitive material processing apparatus according to claim 13, wherein said first roller is disposed above said second roller and said second roller is disposed below said first roller.

19. A photosensitive material processing apparatus according to claim 13, wherein said second roller is disposed above the processing tank such that the photosensitive material is trained around and guided by said second roller.

20. A photosensitive material processing apparatus according to claim 13, wherein a plurality of said pairs of first and second rollers is provided.

* * * * *